United States Patent [19]

Brown

[11] 4,376,042

[45] Mar. 8, 1983

[54] CHIP SIZING PROCESS

[75] Inventor: Robert A. Brown, Arlington, Wash.

[73] Assignee: Weyerhaeuser Company, Tacoma, Wash.

[21] Appl. No.: 262,276

[22] Filed: May 11, 1981

[51] Int. Cl.[3] ..... B07B 9/00

[52] U.S. Cl. ..... 209/38; 209/2; 209/234; 209/44.1; 209/672

[58] Field of Search ..... 209/2 P, 3 P, 4 P, 10, 209/233, 234, 17, 332 P, 271 P, 38, 313, 314, 317, 44.1, 632, 634, 672; 162/17, 18, 52, 55; 241/24, 28

[56] References Cited

U.S. PATENT DOCUMENTS

| | | | |
|---|---|---|---|
| 780,349 | 1/1905 | Johnson | 209/38 X |
| 1,529,970 | 3/1925 | Ullrich | 209/38 X |
| 2,966,267 | 12/1960 | Dunbar | 209/271 |
| 3,220,546 | 11/1965 | Gardner | 209/7 |
| 3,279,597 | 10/1966 | Reinwall | 209/17 |
| 3,337,139 | 8/1967 | Lloyd | 241/28 |
| 3,530,986 | 9/1970 | More | 209/23 X |
| 4,043,901 | 8/1977 | Gauld | 209/10 |
| 4,050,980 | 9/1977 | Schmidt | 162/55 X |
| 4,167,438 | 9/1979 | Holz | 209/17 X |

FOREIGN PATENT DOCUMENTS

| | | | |
|---|---|---|---|
| 624046 | 9/1932 | Fed. Rep. of Germany | 209/234 |
| 311669 | 9/1967 | U.S.S.R. | 209/234 |

OTHER PUBLICATIONS

Rader Chip Thickness Screening/Slicing System, 1979.

Tappi, vol. 59, No. 5, May 1976, Advancing the State of the Art in Screening Bark-Free and Non-Bark-Free Chips, Christensen.

*Primary Examiner*—Ralph J. Hill

*Attorney, Agent, or Firm*—Weyerhaeuser Company

[57] ABSTRACT

A chip screening system has a primary screening station for dividing an incoming flow of chips into a first acceptable fraction and a second fraction having acceptable chips and also both oversized and overthick chips. The second fraction is directed to a second screening station where the incoming flow will again be fractionated into an acceptable flow being screened primarily according to thickness and a second fraction being composed of oversized and overthick chips. The second fraction is then directed to a size reducing station.

9 Claims, 1 Drawing Figure

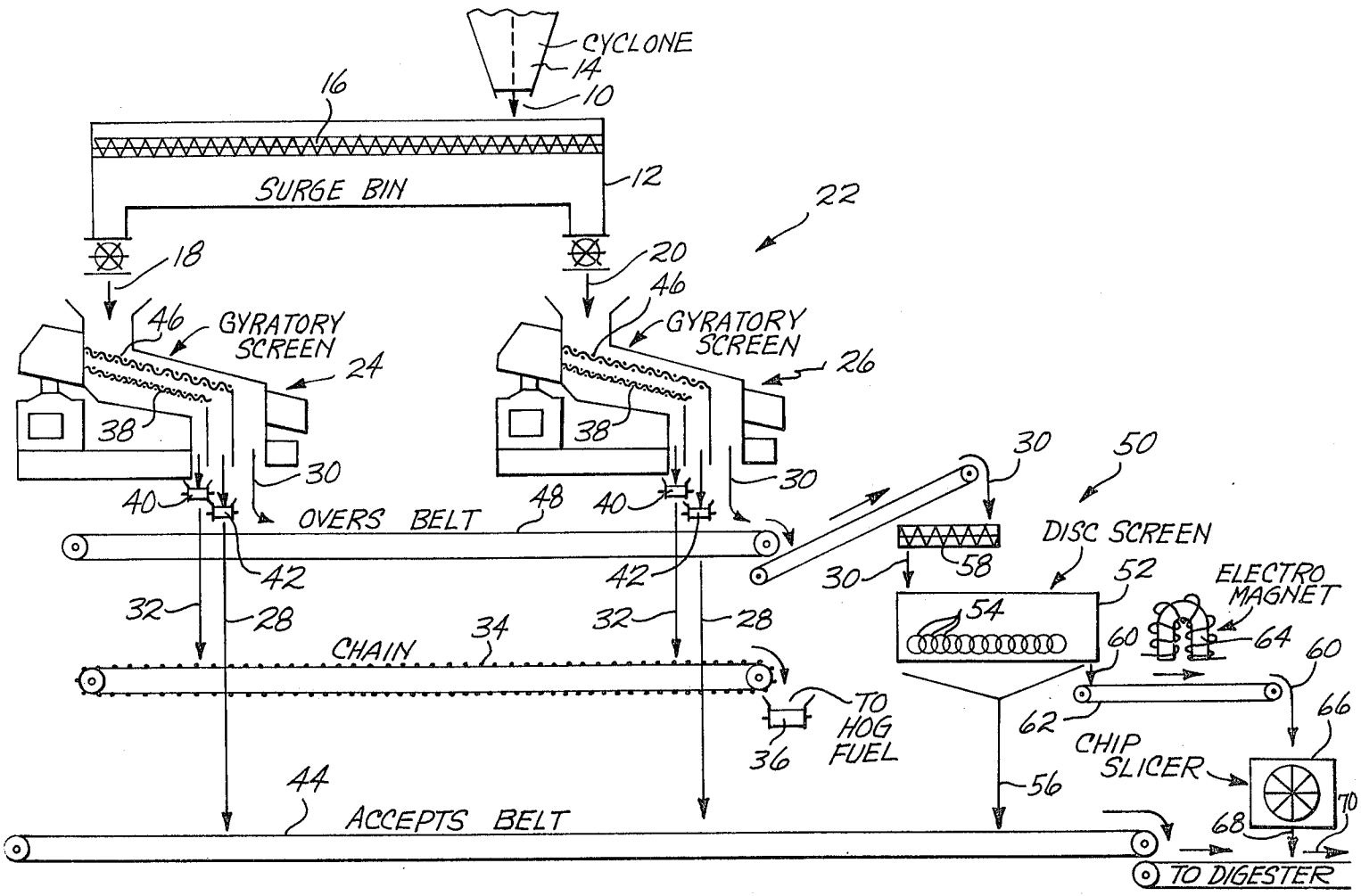
CYCLONE
SURGE BIN
GYRATORY SCREEN
GYRATORY SCREEN
OVERS BELT
CHAIN
ACCEPTS BELT
DISC SCREEN
ELECTRO MAGNET
CHIP SLICER
TO DIGESTER
TO HOG FUEL

CHIP SIZING PROCESS

BACKGROUND AND SUMMARY OF THE INVENTION

This invention relates generally to the pulping of wood chips and more particularly to a screening process for sizing and fractionating a flow of chips prior to pulping.

It has been recognized recently that the thickness dimension of wood chips plays a key role in the pulping process. Briefly, in the pulping process, a digester receives chips and then, through the use of chemicals, pressure, and elevated temperatures, breaks the wood down into its constituents, basically lignin and cellulose. The cellulose (wood fibers) is then further processed before making the pulp product. Of course, as will be well understood by those skilled in the art, in order to produce a uniform high yield pulp, the process must begin with a correctly sized and composed chip flow. Oversized (based on length and width) and overthick chips are not broken down well in the digester and at a subsequent screening stage larger unacceptable particles must be removed, thereby reducing pulp yield.

Undersized chips (referred to commonly as "fines") and other small undesired material in the chip flow such as sawdust and bark particles should also be removed from the flow prior to the digester. The undersized material can be overcooked in the digester and acts to weaken the overall pulp if allowed to remain. Thus, it is very important to generate and produce an optimum furnish (chip flow) for the digester in required quantities and at a low cost.

Chip screening systems are well known and the prior publication of E. Christensen appearing in the May 1976 TAPPI Journal, Vol. 59, No. 5 contains a disclosure of those in use today and in the past. For example, a typical gyratory screen is used in many applications for high particle separation efficiency for a given size of screen. The gyratory screen has less tendency to upend and remove elongated particles (pin chips) and there is less tendency to plug the screen openings with particles close to the opening size. There is also less tendency to abrade and break chips into smaller pieces.

Another typical screening means disclosed in the Christensen publication is the disk screen. It consists of a number of parallel rows of shafts on which properly spaced disks are mounted in such a way that the disks on one shaft are centered in the space between the disks on adjacent shafts. The spacing determines the size of chip that will fall through in any fraction and those that will stay atop the disk screen and be treated as "overs," that is, those that may be oversized and/or overthick. The disk screen, properly constructed, has been found to be especially useful in sorting chips according to the thickness dimension. The Christensen publication is incorporated herein by this reference in order to provide additional background information.

In generating the desired chip flow to feed the digester, one system approach using a disk screen and a gyratory screen in combination is disclosed in the Christensen reference. He suggests that, by first passing an incoming chip flow over a disk screen, the "overs" can be removed expeditiously from the flow and treated as an "overs" fraction. A fraction generated at the disk screen through a portion thereof will be "accepts," that is, chips falling within a predetermined size and thickness range and suitable for flow directly to the digester and another fraction will be the smaller material including pins, fines, sawdust and the like. If pin chips are suitable for the particular digester, they will be separated out and directed to the digester. Overs will be further processed to reduce their size and/or thickness to bring them into the predetermined acceptable range after which the original overs fraction will be a flow ready for the digester.

In most typical digesters, the ideal thickness range for softwood chips is from 2 mm to 10 mm and for hardwood chips from 2 mm to 8 mm. Chips falling within these ranges should come to the digester in a continuous flow and in the right quantity, depending upon the digester requirements.

Of course, chip sources can have a variety of characterizations depending upon their origin. Some sources may have a high percentage falling within the desired size and thickness range with few of the chip particles being either "overs" or "unders." Other sources may have relatively higher percentages of "overs," for example. Since chip sources vary, the screening system is designed with the variable nature of the source of chips in mind. The optimum screening system also, in addition to virtually eliminating overs from the flow, should retain all fiber suitable for digesting. This means pin chips should be used and losses of otherwise useable chips should be eliminated.

It has been found that by causing the incoming chip flow to first be processed by a primary screening station such as a two-deck gyratory screen resulting in three fractions and then causing at least a 30%–60% portion of the total flow which is the fraction not passing through the first deck or screening media to be screened at a second station by a disk screen resulting in two fractions (one being accepts and the other being overthick), not only is the chip flow efficiently processed but the capital cost is significantly reduced. It has also been found that by using two-station screening in the proper sequence, significant improvement in unders removel efficiency occurs. The resulting overthick fraction is passed through a thickness reducing means such as a chip slicer with the resulting flow then being considered "accepts."

If changes in either the process flows (weight/unit of time) or process pulping parameters occur, it had been a problem for prior systems to accommodate such changes without extensive changes and attendant high cost. The present invention allows process changes to be accommodated simply and at low cost without having more than a minimal effect on overall performance of the system.

Briefly, the present invention is practiced in one form by directing a flow of chips from a source typically having a percentage of overs ranging from 0–20% of the total and a similar percentage of unders to a primary screening station where the incoming flow is divided, based primarily on the length and width, into a fraction of overs, a fraction of accepts and a fraction of unders. The overs fraction is directed to a second screening station comprising a disk screen where a fraction of accepts is generated, based primarily on thickness as is a fraction of overs which is directed to a chip thickness reducing means. The accepts from the primary and second screening stations are combined with the flow from the chip reducing means to result in a flow having chips falling within the predetermined dimensional ranges.

Accordingly, from the foregoing, one object of the present invention is to reduce the oversize and/or overthick chips flowing to a digester.

Another object is to reduce the undersize material flowing to the digester.

Yet another object is to provide an efficient chip screening system at a lower capital cost.

A further object of the invention is to quickly and at low cost modify the structure of the system to accommodate process changes.

These and many other objects of the invention will become more apparent and better understood upon reviewing the description to follow in conjunction with the attached drawing.

DESCRIPTION OF THE DRAWING

The single FIGURE of the drawing is a schematic representation of the present invention.

DETAILED DESCRIPTION OF THE PREFERRED EMBODIMENT

First, a detailed description will be given of a suitable combination of elements used to carry out the present invention. In the FIGURE of the drawing, a chip screening process is substantially depicted in schematic form. It is to be noted that the elements forming the system are commercially available and they will be well understood by those skilled in the art.

Shown depositing an incoming flow of chips 10 from an upstream source (not shown) into a surge bin 12 is cyclone 14. A distribution means 16 in bin 12 functions to divide incoming flow 10 into two substantially equally sized (in terms of weight per unit of time) flows 18, 20. The chip flows 18, 20 are generated based upon the demands of a downstream digester (not shown) and other pulping process elements. In addition, prior to beginning the chip screening and process flow for pulping, the source of chips will have been tested and characterized. Thus, the makeup of incoming flow 10 is known in terms of its size and thickness distribution as well as other characteristics necessary for proper overall operation of the pulping process. Size and thickness distribution can be tested by any suitable well-known classification means. A sample from the chip source will be broken down into its different-sized fractions. For example, if the pulping process considers acceptable chips to be within a thickness range of from 3 mm–10 mm and from 3 mm–45 mm in other size dimensions, then the operator must know this distribution. If pin chip (generally from 3 mm–7 mm in thickness) quantity is desirable to know, then it too can be determined. Once the size distribution is known and the digester requirements are known, then a suitable screening process may be established. Simply stated, when the operator knows the dimensions (in terms of size and thickness distribution) and quantity of the chip flow required at the digester and the quality of the chip source upstream from the screening system, then the system can be properly sized and operated. The screening system should be one which offers the highest overall performance, reducing the oversized and overthick chips to acceptable limits flowing to the digester, at the lowest capital and operating cost. For example, one requirement of the pulping process may be that 90% of the overthick chips be reduced before entering the chip flow to the digester. As mentioned in the background, by so reducing the overthick chips to the digester, pulp yield can be increased from the same amount of incoming raw material.

At a primary of first screening station, generally indicated at 22, the chip flow having been divided into separate substantially equal flows 18, 20 is continuously fractionated according to size. In the embodiment depicted, the primary screening station includes a pair of substantially idential two-deck gyratory screens 24, 26. The function of screening station 22, which may be comprised of any suitable screening and fractionating means, is to provide at least first and second separate fractions with the first comprised of chips falling substantially within the acceptable size and thickness range required for the pulping process and the other having a substantial majority of the oversize and overthick chips, as well as a substantial amount of acceptable chips, but less than the amount in the first fraction. In addition, primary screening station 22 may also have means and function to separate from the flow "fines" which are collected and diverted for other uses being unacceptable for making pulp.

In the drawing, the first and second fractions from each gyratory screen 24, 26 are indicated at 28, 30 respectively, and the "fines" fraction or third fraction is indicated at 32. During operation of the invention, typically from 0–12% by weight of the flow 10 will be screened out as "fines" into third fraction 32 collected on endless chain belt 34 and directed to a conveyor line 36 where they will be transported to a fuel bin (not shown), for example. Fines, being the smallest sized particles in flow 10, will pass through the bottom screens or decks 38 of primary screening station 22 to be first collected from each gyratory screen 24, 26 at an end conveyer line 40 where they will be directed to chain belt 34. In a typical installation, screens 38 could be comprised of #4 mesh 12 gauge wire screen with a ball rack to prevent clogging and would function to collect fines having a size of 2–5 mm and less. It should be pointed out here that gyratory screens and other suitable screening means for primary screening station 22 are commercially available from many sources.

Collected on the top of screens 38 will be fraction 28 and it will first be collected along the ends of screens 38 in end conveyor lines 42 where the flow is then directed to an "accepts" conveyor belt 44 which carries the flow on to the digester. Typically, during operation, from 40–72% of incoming flow 10 will be screened out as chips being in an acceptable size range. Not all of the chips in the fraction 28 will be within the desired thickness range but a substantial majority will be. Here, a suitable thickness range is defined as, for example, between 3 mm and 10 mm and only from about 0–15% of fraction 28 will be greater than 10 mm in thickness. Usually, the incoming flow 10 is comprised of from 0–20% overthick chips.

Top sizing screen or deck 46 in each gyratory screen 24, 26 forms the first sizing step in primary screening station 22. Screens 46 are again typical for commercially available gyratory screens and are comprised of suitable screening media. They are located directly above screens 38 and have apertures in their surfaces to allow unders and the chips that will form first fraction 28 to pass. A typical example of aperture size would be a 22 mm square hole substantially uniformally spaced in staggered rows on 28 mm centers. When flows 18, 20 are started, they will be uniformly distributed over the upper end of decks 46 and, due to their inclined orientation and gyratory motion, the second fractions 30 (the chips and other material not passing through the apertures) will be accumulated at the bottom ends of decks 46 where they will be directed to the overs conveyor belt 48. As previously pointed out, fraction 30 will be comprised of chips being oversized in both the thickness and length and width dimensions and some chips that are within the overall acceptable size range but which did not pass through screens 46. The fraction 30 has concentrated within it substantially all of the overthick chips, only a small portion having passed through the first stage of screening on screens 46 as previously pointed out. Of course, all oversized chips are collected and become part of second fractions 30.

Fraction 30 is then directed to a second screening station indicated at 50. Screening station 50 is comprised of any suitable means that functions to fractionate flow 30 into at least two additional flows with one being comprised of chips having a thickness falling within the acceptable range and the other being comprised of chips having a thickness above the acceptable range. In the embodiment depicted, station 50 is comprised of a suitably sized commercially available disk screen 52. Disk screen 52 has a plurality of rotating disks 54 mounted on shafts (not shown) and spaced apart a distance that is preselected to pass chips having a thickness within the acceptable range. For example, in a typical installation, a suitable disk spacing might be set at 7 mm, with chips having a greater thickness remaining on the top of screen 52. The resulting fraction is indicated as flow 56 and is a fourth fraction being comprised of chips, all of which substantially fall within the acceptable predetermined size and thickness requirements of the pulping process. Flow 56 is directed to accepts conveyor belt 44 which carries the chips to the digester or to a storage area for the digester. Serving to uniformly distribute flow 30 over the infeed end of disc screen 52 is suitable flow distribution means indicated at 58.

The chips from flow 30 that are substantially all oversize and/or overthick ride along the top of disks 54 to the outfeed end where they form yet another fifth fraction indicated at 60. This fraction represents substantially all of those chips that were originally characterized to be both oversized and overthick in the incoming flow 10 and in a typical example would represent about 1–20% by weight of the original incoming flow 10. This fraction is directed to conveyor line 62 where it is conveyed past a means such as electromagnet 64 to remove any remaining metal elements. Fraction 60 is then directed to a size-reducing means and in the preferred embodiment is a commercially available chip slicer indicated at 66. The function of size-reducing means is to produce chips falling substantially within the acceptable size range and preferably also within the acceptable thickness range. Chip slicer 66, during operations, functions to reduce all chips within fraction 60 to a thickness within the acceptable range. As the chips flow from slicer 66, substantially all chips are suitable for the pulping process and are directed to accepts conveyor belt 44. This fraction indicated at 68 will have virtually no overthick chips. As an alternative, reduced chips could be redirected to incoming flow 10 at surge line 16 where they could pass through the screening process again. If, however, chip slicer 66 functions efficiently, it will produce the fraction 68 suitable for immediate use in the digester without additional screening.

The fractions 28, 56, and 68 flowing to accepts conveyor belt 44 collectively will constitute chip flow 70 being within the acceptable predetermined limits for the pulping process. If desired, substantially all fines have been removed as have substantially all of the oversized chips. The oversized chips will have been reduced in size. The portion of overthick chips remaining in flow 70 will be within the preselected limit determined by the pulping requirements.

By providing a screening system that concentrates the overthick chips at a primary screening station and directing the flow having the concentrated amount of overthick chips to a second screening station to particularly screen for thickness, not only is the efficiency increased in reaching the desired predetermined characteristics for flow 70, but the capital cost is reduced. Capital is reduced because a smaller second screening station is required to yield the same overall performance for flow 70. In effect, the flow 30 directed to second screening station 50 is minimized but has the overthick chips concentrated therein for better screening at the second screening station.

If changes in the flow rate or downstream pulping parameters occur, this invention has the capability of compensating for those changes. This is accomplished by simply modifying the top decks 46 (at low cost) of primary screening station 22 with only a minimal effect on overall system performance.

While a detailed description has been given of a preferred embodiment which will enable one skilled in the art to make and use the invention, it may occur to those who are skilled in the art to make modifications that have not been described. All such modifications as well as the invention described are intended to be included within the scope of the following claims.

I claim:

1. A process for fractionating and sizing a flow of incoming wood chips from a known source into an output flow of chips falling in a predetermined size range with substantially all of the chips in the output flow having a thickness falling within a predetermined thickness range, comprising the steps of:

directing the incoming flow to a primary screening station where at least two fractions are generated with a first fraction containing chips falling substantially within the predetermined acceptable size and thickness range and a second fraction comprising at least 30% by weight of the incoming flow having a substantial majority of the oversize and overthick chips together with a substantial amount of chips falling within the acceptable size and thickness range, and directing the second fraction to a second screening station where at least two fractions are generated with a fourth fraction containing chips falling substantially within the predetermined acceptable size and thickness range and a fifth fraction containing chips substantially all of which are overthick.

2. The process as in claim 1 further including the step of directing the fifth fraction to a size reducing means.

3. The process as in claim 2 in which the size reducing means is a chip slicer generating chips falling substantially within the acceptable thickness range.

4. The process as in claim 2 further including the step of directing the fifth fraction past a metal removal means in order to remove metal elements prior to directing the fifth flow to the size reducing means.

5. The process as in claim 2 further including the step of directing the output flow from the size reducing means back to the primary screening station where it is merged into the incoming flow.

6. The process as in claim 2 including the step of collecting all fractions containing chips falling within the predetermined acceptable size and thickness range.

7. The process as in claim 1 in which a third fraction is generated containing chips falling substantially in a size range below the acceptable range.

8. The process as in claim 1 in which the primary screening station is a gyratory screen.

9. The process as in claim 1 in which the second screening station is a disc screen.

* * * * *